United States Patent [19]

Shoop

[11] Patent Number: 5,020,566

[45] Date of Patent: Jun. 4, 1991

[54] FUEL SUPPLY SYSTEM FOR PORTABLE ENGINE DRIVEN EQUIPMENT

[75] Inventor: John C. Shoop, LaPorte, Ind.

[73] Assignee: Sullair Corporation, Michigan City, Ind.

[21] Appl. No.: 566,936

[22] Filed: Aug. 13, 1990

[51] Int. Cl.[5] ..... F02M 37/00

[52] U.S. Cl. ..... 137/265; 137/192

[58] Field of Search ..... 137/255, 265, 38, 192

[56] References Cited

U.S. PATENT DOCUMENTS

| | | | |
|---|---|---|---|
| 2,320,913 | 6/1943 | Crowell . | |
| 2,703,138 | 3/1955 | Amon | 137/265 X |
| 3,101,771 | 8/1963 | McCuen . | |
| 3,530,876 | 9/1970 | Stoner . | |
| 3,981,321 | 9/1976 | Risse | 137/255 |
| 4,411,239 | 10/1983 | Kelch . | |
| 4,715,345 | 12/1987 | Reames, Jr. . | |
| 4,763,633 | 8/1988 | Nakanishi . | |

*Primary Examiner*—Alan Cohan
*Attorney, Agent, or Firm*—William D. Lanyi

[57] ABSTRACT

A fuel supply system for a portable engine driven device is provided which comprises two fuel tanks that are spaced apart from each other. The two fuel tanks are connected in fluid communication by a first conduit that is connected to each fuel tank at a bottom portion thereof and at a region of that bottom portion which is closest to the other fuel tank. A fluid pumping means is provided and connected in fluid communication with each of the two fuel tanks for pumping a liquid from the two fuel tanks toward a device which requires the use of the fluid. For example, if the liquid in the tanks is a liquid fuel, it can be pumped for use by an internal combustion engine. In addition, the internal combustion engine can be connected in torque transmitting relation with a compressor such as in a portable engine driven compressor apparatus.

17 Claims, 4 Drawing Sheets

FUEL SUPPLY SYSTEM FOR PORTABLE ENGINE DRIVEN EQUIPMENT

BACKGROUND OF THE INVENTION

1. Field of the Invention

The present invention is related generally to a fluid supply system and, more specifically, to a dual fuel tank system for use in conjunction with portable engine driven equipment such as a portable compressor.

2. Description of the Prior Art

When portable engine driven equipment is used, one recurring problem relates to the fuel supply system that provides for a flow of fuel from a storage tank to an internal combustion engine. When the portable equipment is parked on terrain which is not level, the fuel will be caused to flow toward one side of the fuel tank. If the fuel pickup conduit is located at an opposite end of the tank, the engine could be deprived of fuel prior to the depletion of all of the fuel that is stored in the tank.

In order to expand the total capacity of fuel stored in a portable engine driven apparatus, it is known that two fuel tanks can be used. An advantage of using two fuel tanks, rather than one very large fuel tank, is that it permits the location of these tanks to be placed at convenient positions on the apparatus. However, if the device is parked on unlevel ground, both fuel tanks could be tilted in such a way that the fuel pickup conduit is not disposed within the fuel even though additional liquid fuel is available within the two storage tanks. Although it is known to use two fuel tanks in a portable apparatus, usually only one of the two fuel tanks is provided with a fuel pickup conduit. Most typically, the other fuel tank is provided with a return line from the fuel system of the engine. Therefore, even if the two fuel tanks are connected in fluid communication with each other, all of the fuel can be caused to move away from the fuel pickup conduit when the vehicle is parked on unlevel ground. Therefore, the mere use of two fuel tanks does not solve the problem described above.

U.S. Pat. No. 4,715,345, which issued to Reames, Jr. on Dec. 29, 1987, discloses an automatic fuel shutoff system for fuel injected engines. It provides an assembly which is positioned between a main fuel supply and a fuel injection system of a fuel injected gasoline engine or diesel engine. When the main fuel supply becomes exhausted, the fuel flow to the fuel injection system is automatically shut off, causing the engine to cease operating because of fuel starvation. This prevents air from entering the fuel injection system. The assembly described in this patent forms a reserve supply of fuel and utilizes the vacuum created by the fuel starved engine in such a way as to insure that no air becomes entrained in the fuel injection system when operation of the system is resumed following the replenishment of the fuel supply.

U.S. Pat. No. 4,763,633, which issued to Nakanishi on August 16, 1988, describes a fuel supply system for a small boat in which the fuel supply system comprises a suction pipe which has an inlet opening within a fuel tank. A fuel retention device is connected to the pipe around the inlet opening and it retains fuel at the inlet opening to prevent air from entering the opening when the opening is above the fuel level for a brief period of time.

U.S. Pat. No. 2,320,913, which issued to Crowell on June 1, 1943, describes a liquid fuel or lubricant supply tank. This patent describes a fuel tank which contains a plurality of compartments that are all connected in fluid communication with each other. A piping arrangement is provided to connect each of the compartments to each of the other compartments for the purpose of permitting fuel to flow freely between associated compartments of the main fuel tank. If one of the compartments is emptied, such as would result from a piercing of the wall of one of the compartments, a device attached to the ends of the piping prevents fuel from flowing from one of the other compartments into that emptied compartment.

U.S. Pat. No. 4,411,239, which issued to Kelch on Oct. 25, 1983, describes a fuel cooling system for use with a closed fuel injection circuit in a diesel engine. Although this patent describes a device which is not directly related to the present invention, it does illustrate an example where a fuel tank is provided with two fuel pickup conduits. The cooling system for the fuel used in a diesel engine, according to this patent, includes a closed fuel injection circuit and a fuel cooling circuit. The fuel cooling circuit flows fuel to and from the fuel tank. A heat exchanger is connected to a fuel injection circuit and the fuel cooling circuit and flows the fuel from the fuel injection circuit in indirect heat transfer relation with the fuel in the cooling circuit for removing heat from the fuel in the injection circuit.

U.S. Pat. No. 3,101,771, which issued to McCuen on Aug. 27, 1963, discloses a liquid fuel system for vehicles. It describes a system which contains two fuel tanks wherein each fuel tank is provided with a single fuel pickup conduit and a single fuel return conduit. A separate containment is also provided for an intermediate storage of fuel between the main storage tanks and the carburetor of the vehicle. Fuel is pumped from the two main storage tanks into the intermediate tank and overflowing fuel is returned from the intermediate tank back to the main storage tanks. The pickup conduits and the return conduits are each provided with valves for selectively opening and closing these conduits.

U.S. Pat. No. 3,530,876, which issued to Stoner on Sept. 29, 1970, describes a control valve for a brine tank of a water softener system. It describes an apparatus for controlling the liquid into and out of the brine tank. A conduit through which fresh water is admitted to the tank and brine is withdrawn from the tank ends in a valve plug placed substantially above the tank bottom. The valve comprises a vertically elongated, vertically movable valve chamber which surrounds the valve plug and has top and bottom valve seats which cooperate with the plug to shut off liquid flow through the pipe. The chamber has a float to cause it to rise and fall with the level in the brine tank. The chamber has an opening near its bottom in communication with the liquid in the tank.

SUMMARY OF THE INVENTION

The present invention is directed toward providing a means by which the fuel capacity of a portable engine driven apparatus can be significantly increased while also permitting the engine to draw substantially all of the stored fuel from both of two fuel tanks regardless of the fact that the apparatus is parked on terrain which is significantly sloped, causing the fuel within both of the tanks to flow toward one side of each tank and deprive the other side of the tank of liquid fuel.

The present invention provides a fuel supply system which comprises a first and a second fuel tank. The two fuel tanks are connected in fluid communication with each other by a first conduit. The first and second fuel tanks are spaced apart from each other but are connected in fluid communication by the first conduit. The present invention further comprises a means for pumping fluid from the two fuel tanks. This pumping means, which can be a fuel pump, is connected in fluid communication with each of the two tanks by individual conduits. The two conduits connecting the pumping means to the fuel tanks can be connected in fluid communication with each other. In a preferred embodiment of the present invention, an internal combustion engine is connected in fluid communication with the pumping means so that fuel can be caused to flow from one or both of the fuel tanks to the internal combustion engine. In a most preferred embodiment of the present invention, a compressor is connected in torque transmitting relation with the internal combustion engine.

The conduit connecting the first tank in fluid communication with the second tank is preferably attached to the bottom portions of the fuel tanks at portions of each tank which are closest to the other tank. For example, the connection to each fuel tank is made at a side of the fuel tank which is closest to a point which lies between the two spaced apart tanks. In addition, the conduits by which the pumping means is connected in fluid communication with the fuel tanks are disposed in fluid communication with a portion of each tank that is proximate the bottom of the internal volume of each tank and, in addition, located at a portion of the bottom half of each tank which is farthest from the other tank.

As an example, if the two fuel tanks are arranged at the left and right sides of a portable apparatus, the first conduit connecting the two fuel tanks in fluid communication with each other would be connected to the bottom portions of both tanks and, in a preferred embodiment of the present invention, would be connected to the right side of the left tank and the left side of the right tank. In addition, the fuel pickup conduits which connect each of the two fuel tanks in fluid communication with the pumping means would be disposed in fluid communication with the bottom portions of the internal volume of each tank and, in a preferred embodiment of the present invention, would be connected in fluid communication with the left side of the left tank and the right side of the right tank or, in other words, would be connected to the outside region of each of the two fuel tanks.

In a preferred embodiment of the present invention, each of the fuel tank pickup conduits, which connect the tank with the pumping means, is provided with a means for preventing fluid communication between the pumping means and the tank when a level of liquid in the tank falls below a predetermined magnitude. In other words, if the fuel level in the first tank falls below a predetermined height, the pickup conduit connecting that tank with the pumping means would be shutoff by the preventing means so that the pumping means would not draw gas from the ullage above the fluid level in the empty or predominately empty tank. Each of the fluid conduits connecting the fuel tanks with the pumping means is provided with a separate shutoff means that perform this function. Therefore, if one of the two tanks is empty, the pumping means can draw fuel from the other tank because the empty or predominately empty tank is disconnected from fluid communication with the pumping means and is prevented from drawing gas from the ullage of that empty tank.

BRIEF DESCRIPTION OF THE DRAWING

The present invention will be more fully understood from a reading of the description of the preferred embodiment in conjunction with the drawing, in which.

DESCRIPTION OF THE PREFERRED EMBODIMENT

Figure 1:
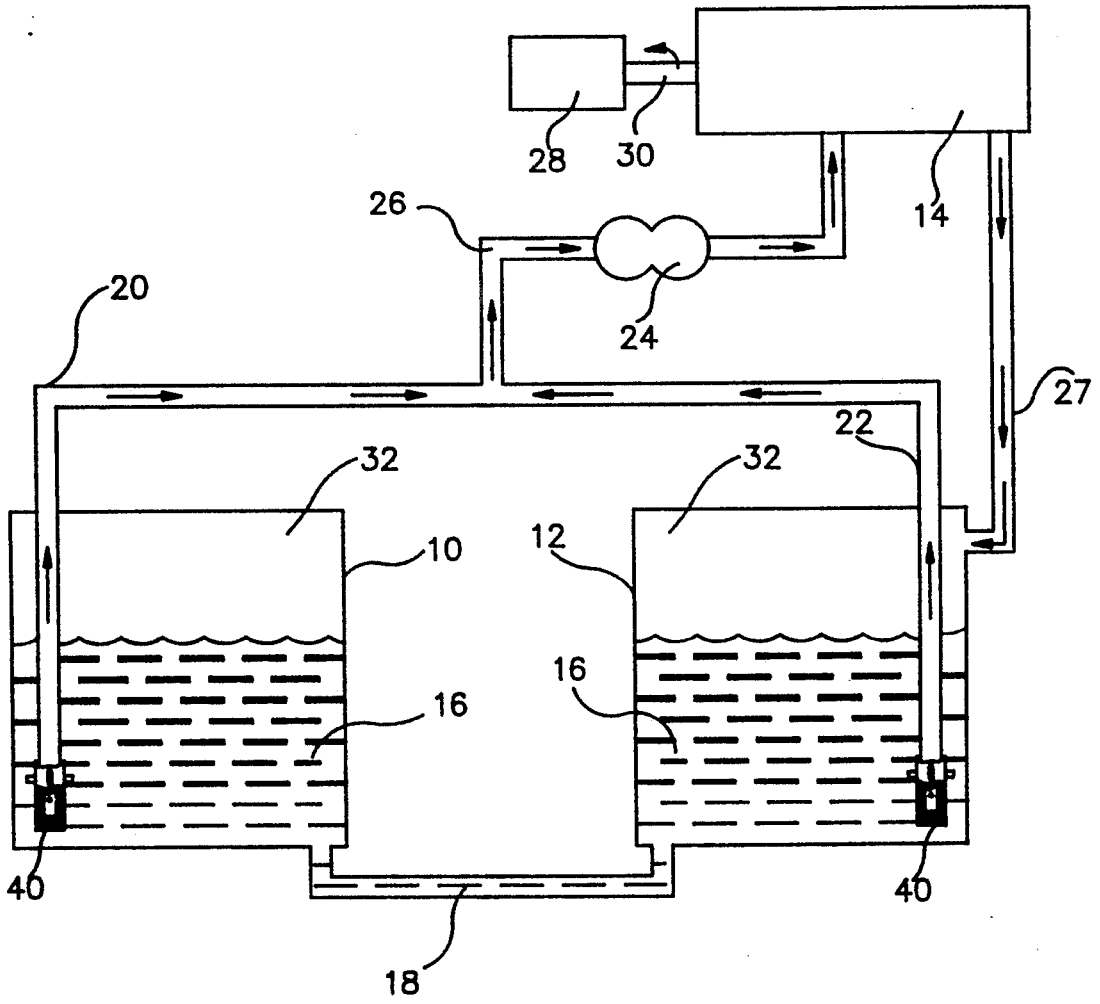
FIG. 1 illustrates the basic concept of the present invention when the portable apparatus is parked on level ground.

Throughout the description of the preferred embodiment, like elements will be described by like reference numerals and, in addition, the U.S. patents described above by number are expressly incorporated by reference in this description.

FIG. 1 illustrates the basic concept of the present invention. A first fuel tank 10 and a second fuel tank 12 are provided for use in supplying fuel to an engine 14. Fuel 16, or an alternative fluid provided for use by some type of equipment, is contained in both the first and second tanks. A first conduit 18 is provided to connect the first tank 10 in fluid communication with the second tank 12. As can be seen in FIG. 1, the first conduit 18 is connected to the bottom portions of both tanks. In addition, it can be seen that the first conduit 18 is connected to the portions of each tank which are closest to the other tank. In other words, the first conduit 18 is connected to the bottom portion of the first tank 10 which is closest to the second tank 12 and vice versa. While being connected to the bottom portions of the tanks, conduit 18 is also positioned so as to provide sufficient ground clearance for the vehicle on which the fuel tanks are disposed.

The present invention is provided with a means for pumping fluid from the first and second tanks toward the engine 14. That pumping means 24 can be a fuel pump or any alternative technique suitable for causing a flow of fluid from the first and the second tanks toward the engine 14. It should be understood that, under certain unique circumstances and for certain types of equipment, gravity may suffice to cause the flow of fuel from the two fuel tanks to the engine.

The pumping means 24 is connected in fluid communication with the first tank 10 by a second conduit 20. The pumping means 24 is also connected in fluid communication with the second tank 12 by the third conduit 22. In a preferred embodiment of the present invention, the second conduit 20 and the third conduit 22 are connected in fluid communication with each other, as shown in FIG. 1, and the pumping means 24 is connected to this common connection point by a fourth conduit 26. The arrows in FIG. 1 indicate the direction of fluid flow from the first and second tanks to the engine 14. As shown in the Figures, a typical fuel system incorporates a fuel return line 27 which serves as a conduit for excess fuel to return to the fuel tanks from the engine 14. The use of a return line 27 is typical in fuel supply systems associated with diesel engines.

In a preferred embodiment of the present invention, the engine 14 is an internal combustion engine supplied with fuel from the two tanks. In addition, the engine 14 is connected in torque transmitting relation with a compressor 28 that is driven by a shaft 30 which, in turn, is caused to rotate by the engine 14.

In FIG. 1, the two fuel tanks are shown to be arranged at generally equivalent heights as would occur if the apparatus containing the fuel tanks was parked on level ground. Under these circumstances, the amount of fuel 16 in each tank is approximately equal as is the volume of the ullage 32 in each tank. Under these circumstances, fuel can be drawn from either or both of the tanks by the pumping means since the ends of the second and third conduits are both disposed below the level of the liquid 16. Although the two fuel tanks shown in the figures are illustrated as being generally identical in size, it should be understood that this similarity in size is not a requirement of the present invention and, instead, the two fuel tanks may differ significantly in both size and shape.

It should be noted that the second conduit 20 and the third conduit 22, which connect the first and second tanks, respectively, in fluid communication with the pumping means 24, are disposed at the outside regions of their respective fuel tanks. In other words, the end of the second conduit 20 is disposed in the first tank 10 at a portion of the internal volume of the first tank which is located proximate the bottom of the tank and the end of the second conduit 20 is disposed at the outside portion of this bottom region or, alternatively stated, at the side of the bottom region the first tank 10 which is farthest from the second tank 12. Similarly, the end of the third conduit 22 is also disposed in the bottom region of the second tank 12 at a portion of that bottom region which is farthest from the first tank 10. The reasons for the positioning of the ends of the second and third conduits and, in addition, the reasons for the positioning of the connections between the first conduit 18 and the first and second tanks will be described in detail in conjunction with FIG. 2.

Figure 2:
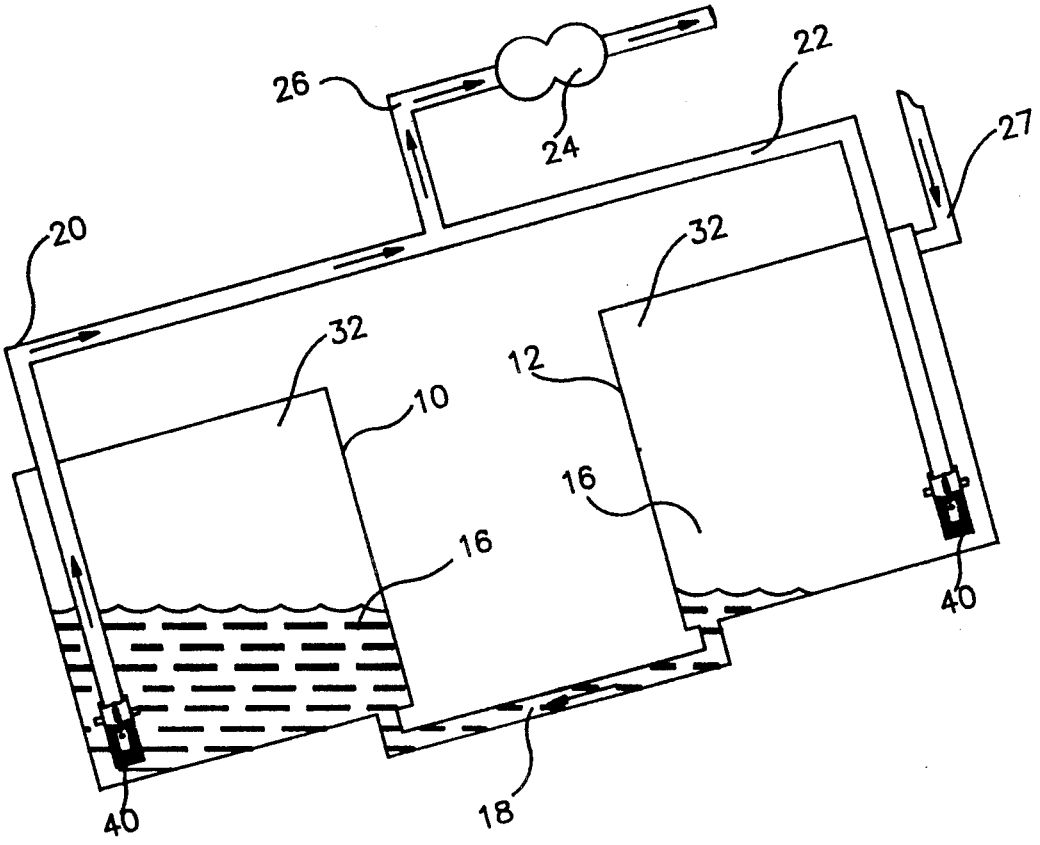
FIG. 2 shows the present invention in operation when the portable apparatus is parked on unlevel ground.

FIG. 2 illustrates the present invention in operation when the apparatus containing the fuel tanks is parked on ground which is not level. Parking the apparatus on a slope results in a redistribution of the fuel 16 within the first and second fuel tanks. It should be understood that, for clarity, the engine 14 and compressor 28 of FIG. 1 are not shown in FIG. 2. Because of the fact that the apparatus containing the fuel tanks of the present invention is parked on sloped terrain, the first fuel tank 10 is disposed at a location below the height of the second fuel tank 12. Since the first conduit 18 is provided, the liquid 16 in both tanks is permitted to seek its desired level which is equal in each of the two tanks. Therefore, a significant proportion of the fuel 16 flows through the first conduit 18 from the second tank 12 into the first tank 10, as shown in FIG. 2. In addition, the slope of the terrain on which the apparatus is parked is sufficient to cause enough fuel 16 to flow out of the second fuel tank 12 for the end of the third conduit 22 to be disposed above the surface of the fuel 16 and within the ullage 32 of the second fuel tank 12. If no precautions were taken, the pumping means 24 would cause gas to flow from the ullage 32 of the second fuel tank 12 through the third conduit 22 and toward the engine 14. This is a severely deleterious circumstance and the present invention provides a means for preventing its occurrence. That means, identified by reference numeral 40 in FIG. 2, is associated with the end of the second conduit 20 and the third conduit 22 for preventing gas from being drawn from the respective conduits when the end of the conduit is above the surface of the liquid 16 in the tank. The operation of that device 40 will be described in greater detail below in conjunction with FIG. 3.

Since the end of the second conduit 20 is below the liquid level, the device 40 in the first tank permits fluid communication between the pumping means 24 and the first tank 10. Therefore, the fuel 16 will continue to be drawn from the first fuel tank 10 while the device 40 within the second fuel tank 12 prevents gas from being drawn from the ullage 32 in the second fuel tank. As fuel 16 continues to be drawn from the first tank 10, fuel will flow from the second tank 12, through the first conduit 18, into the first tank 10 as the fuel level continues to seek its common height in the two tanks. As the fuel level continues to drop, all of the fuel will be drained from the second tank 12 and, eventually, all or nearly all of the fuel will be drawn from the first tank 10 until the fluid level in the first tank 10 falls below a predetermined magnitude relative to the device 40 in the first tank 10. By viewing FIG. 2, it can be seen that the present invention provides a means for increasing the overall capacity of fuel storage of a portable apparatus by providing dual tanks which can be located at virtually any location on the portable device. The two tanks are spaced apart but connected in fluid communication with each other by the first conduit 18. In addition, each of the two tanks is connected in fluid communication with a pumping means which, in turn, is provided with a connection to an engine that is capable of driving a compressor. By observing FIG. 2 in comparison with FIG. 1, it can be seen that the present invention also provides a means which permits virtually all of the fuel stored in the two separated tanks to be used by the engine regardless of the slope on which the apparatus is parked.

Figure 3:
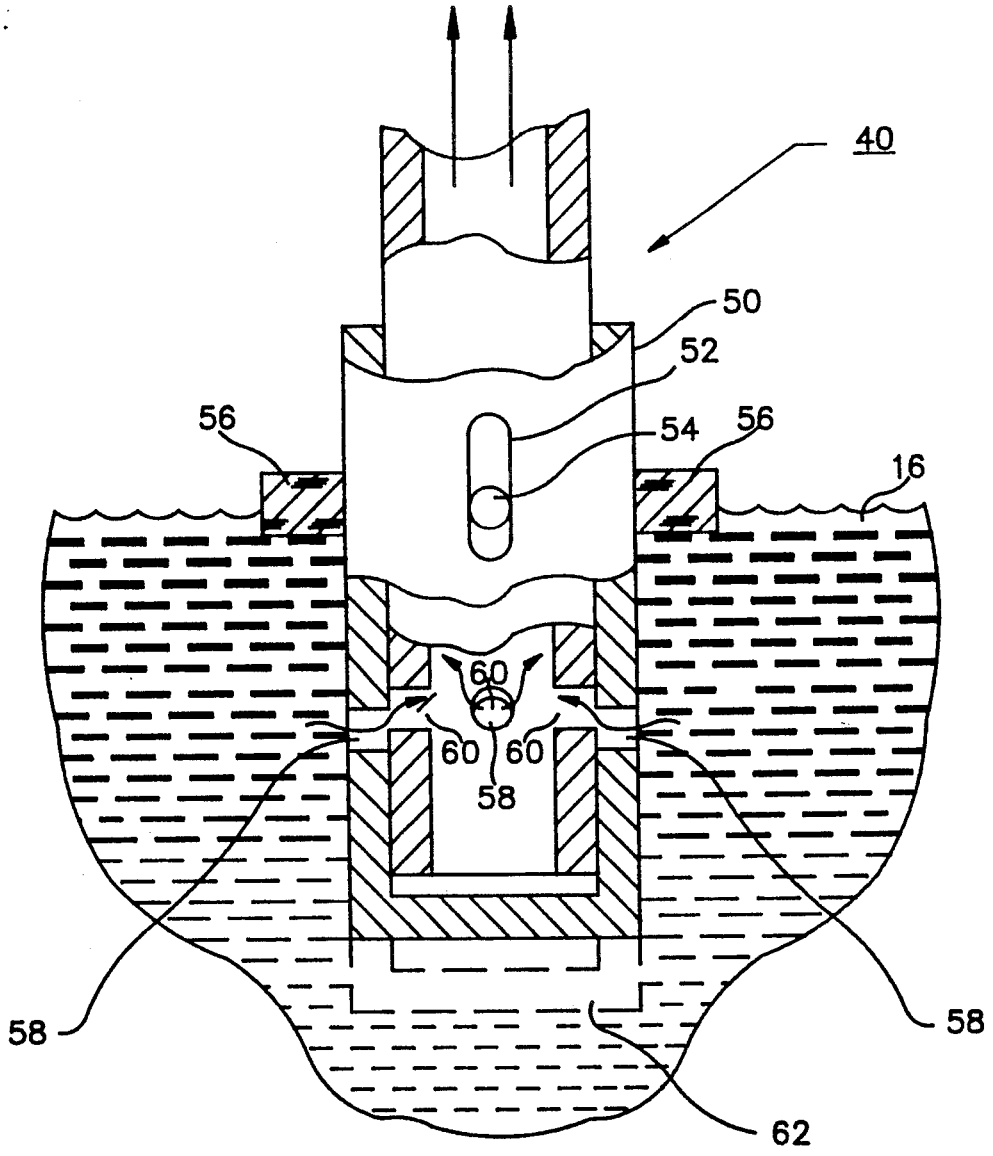
FIG. 3 shows one of many alternative devices suitable for preventing fluid communication between a fuel tank and the pumping means when the liquid level falls below a predefined magnitude.

FIG. 3 illustrates one of several alternative means that can be used to provide the device identified by reference numeral 40 in FIGS. 1 and 2 and described above as a means for preventing fluid communication between the pumping means 24 and its associated fuel tank when the liquid level in that associated fuel tank falls below a predefined magnitude. Any type of device which is capable of performing this function is suitable for use in association with the present invention. Furthermore, it should be understood that although FIG. 3 illustrates one specific device which performs this task, many alternative techniques can be used in association with the present invention.

In FIG. 3, reference numeral 40 is used to described the overall device which is incorporated in association with the end of a fluid conduit for the purpose of preventing fluid communication between some device, such as the pumping means 24, and the tank in which the end of the conduit is disposed when a liquid level within that tank falls below a predefined magnitude. For purposes of this description, it will be assumed that FIG. 3 illustrates the particular device 40 that is shown disposed within the second tank 12 in either FIG. 1 or FIG. 2. As can be seen in FIG. 3, the third conduit 22 is disposed within the second tank 12 (not shown in FIG. 3) and with an end of the third conduit 22 extending downward into the fuel 16.

A collar 50 is disposed around the end of the third conduit 22 and is arranged to be slidably associated with the third conduit. As illustrated in FIG. 3, collar 50 can move up and down relative to the third conduit. This up and down movement of collar 50 is restrained by the combined operation of a slot 52 formed in the collar 50 and a pin 54 rigidly attached to the third conduit 22. The upper and lower ends of the slot 52 define the range of travel of the collar relative to the third conduit 22. In one particular embodiment of the present invention, a flotation device 56 is provided to permit the buoyancy of the collar 50 to be advantageously chosen to move with the liquid level within the tank. As the fuel level 16 rises, the collar 50 is also caused to rise relative to the third conduit 22. Alternatively, when the fuel level falls, the collar 50 moves downward relative to the third conduit 22 within the constraints provided by the slot 52 and the pin 54. The collar is provided with a plurality of holes 58 and the third conduit 22 is provided with a plurality of holes 60. As the collar 58 moves with respect to the third conduit 22, holes 58 and 60 move relative to each other either into alignment or out of alignment depending on the relative positions of the elements. As shown in FIG. 3, holes 58 and 60 are in partial alignment. This partial alignment permits fluid to flow, as indicated by the arrows, through holes 58 and 60 and into the internal portion of the third conduit 22, continuing upward as caused by the action of the pumping means 24.

As the level of the fuel 16 falls, the collar 50 will move downward to the position indicated by the dashed line 62. When this occurs, holes 58 and holes 60 will no longer be aligned and fluid communication between the fuel 16 and the inner portion of the third conduit 22 will be blocked. The downward movement of the collar 50 will therefore permit fluid communication between the second fuel tank 12 and the pumping means 24 by preventing gas from being drawn from the ullage of an empty or predominantly empty tank.

Although one particular embodiment of the preventing means 40 is illustrated in FIG. 3 and described in detail above, it should clearly be understood that the present invention is not limited by this description and, furthermore, that the present invention can be operated in association with any equivalent device that is capable of preventing fluid communication between the fuel tanks and the pumping means when the fuel level within the tank falls below a predetermined level. The purpose of this device is to prevent the fuel pump from drawing gas upward through its associated conduits and depriving the engine of fuel that could otherwise be drawn from the other fuel tank.

Figure 4:
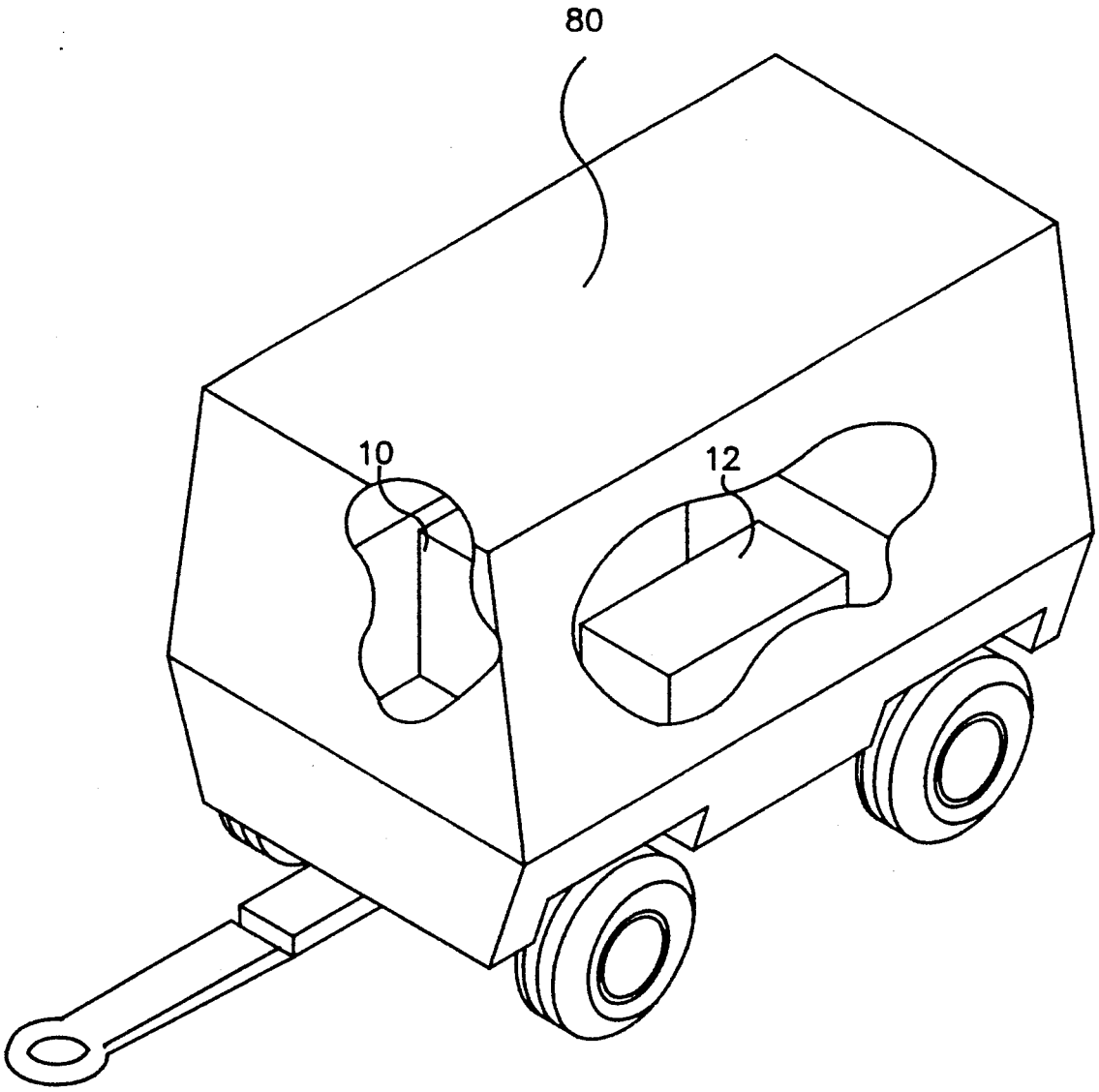
FIG. 4 shows a typical portable apparatus having two fuel tanks that are spaced apart.

FIG. 4 shows an exemplary portable engine driven device 80 that has two fuel tanks, 10 and 12, which are spaced apart from each other. The first, second and third conduits are not shown in FIG. 4 but it should be understood that they would be located as indicted in FIGS. 1 and 2. Similarly, for simplicity, FIG. 4 does not show the pumping means, the engine on the compressor described above and shown in FIG. 1. The purpose of FIG. 4 is to show an exemplary location of the fuel tanks in a portable device.

Although the present invention has been illustrated in detail and described with significant specificity, it should be understood that alternative embodiments of the present invention are within its scope. In addition, it should be clearly understood that although the preferred embodiment of the present invention has been described in relation to the association of two fuel tanks, additional tanks can be included. Three fuel tanks, with interconnecting conduits to perform the function of conduit 18 and fuel lines, similar to fuel lines 20 and 22 associated with each of the three or more fuel tanks. It should be apparent to one skilled in the art that the principles and concepts described above in conjunction with two fuel tanks can easily be applied to fuel supply systems incorporating three or more tanks.

What I claim is:

1. A fluid supply system, comprising:

a first tank;

a second tank;

a first conduit connecting said first tank in fluid communication with said second tank, said first conduit being connected to the bottom segments of said first and second tanks, said first conduit being external to both said first and second tanks, said first conduit is connected to a portion of said bottom segment of said first tank that is proximate said second tank, said first conduit is connected to a portion of said bottom segment of said second tank that is proximate said first tank;

means for pumping fluid from said first and second tanks;

a second conduit connecting said pumping means in fluid communication with said first tank; and a third conduit connecting said pumping means in fluid communication with said second tank;

means, associated with said second conduit, for preventing said fluid communication between said pumping means and said first tank when a level of liquid in said first tank is below a predefined magnitude; and means, associated with said second conduit, for preventing said fluid communication between said pumping means and said second tank when a level of a liquid in said second tank is below a predefined magnitude, said second conduit being connected in fluid communication with a region of a bottom portion of the volume of said first tank that is farthest from said second tank and said third conduit being connected in fluid communication with a region of a bottom portion of the volume of said second tank that is farthest from said first tank.

2. The system of claim 1, wherein:

said second conduit is connected in fluid communication with said third conduit.

3. The system of claim 1, further comprising:

an internal combustion engine connected in fluid communication with said pumping means.

4. The system of claim 1, wherein:

said fluid in said first and second tanks is liquid fuel.

5. The system of claim 2, further comprising:

an internal combustion engine connected in fluid communication with said pumping means.

6. The system of claim 5, wherein:

said fluid in said first and second tanks is liquid fuel.

7. A fluid supply system, comprising:

first means for storing a fluid;

second means for storing a fluid, said second storing means being spaced apart from said first storing means;

first means for connecting said first storing means in fluid communication with said second storing means, said first connecting means being connected to the bottom portions of said first and second storing means;

means for pumping a fluid from said first and second storing means;

second means for connecting said pumping means in fluid communication with said first storing means, said second connecting means having an end disposed proximate the bottom half of said first storing means; and third means for connecting said pumping means in fluid communication with said second storing means, said third connecting means having an end disposed proximate the bottom half of said second storing means, said first connecting means being connected to a region of said bottom portion of said first storing means which is proximate said second storing means, said second connecting means being connected to a region of said bottom portion of said second storing means which is proximate said first storing means, said end of said second connecting means being disposed in a portion of said bottom half of said first storing means that is farthest from said second storing means, said end of said third connecting means being disposed in a portion of said bottom half of said second storing means that is farthest from said first storing means.

8. The system of claim 7, further comprising:

fourth means for connecting said second connecting means in fluid communication with said third connecting means.

9. The system of claim 8, further comprising:

an internal combustion engine connected in fluid communication with said pumping means.

10. The system of claim 9, wherein:

said fluid in said first and second storing means is a liquid fuel.

11. The system of claim 10, further comprising:

a compressor connected in torque transmitting communication with said internal combustion engine.

12. The system of claim 7, further comprising:

an internal combustion engine connected in fluid communication with said pumping means.

13. The system of claim 7, wherein:

said fluid in said first and second storing means is a liquid fuel.

14. A fuel supply system, comprising:

a first fuel tank;

a second fuel tank, said first and second fuel tanks being spaced apart from each other;

a first fluid conduit connecting said first fuel tank in fluid communication with said second fuel tank, said first fluid conduit being connected to the bottom of said first fuel tank at the side of said first fuel tank which is closest to said second fuel tank, said first fluid conduit being connected to the bottom of said second fuel tank at the side of said second fuel tank which is closest to said first fuel tank;

a fuel pump;

a second fluid conduit connecting said fuel pump in fluid communication with said first fuel tank;

a third fluid conduit connecting said fuel pump in fluid communication with said second fuel tank, said second fluid conduit being connected to a side of said first fuel tank that is farthest from said second fuel tank and said third fluid conduit being connected to a side of said second fuel tank that is farthest from said first fuel tank;

means for preventing said fluid communication between said fuel pump and said first fuel tank when a liquid level within said first fuel tank is below a predefined magnitude; and means for preventing said fluid communication between said fuel pump and said second fuel tank when a liquid level witin said second fuel tank is below a predefined magnitude.

15. The system of claim 14, wherein:

said second fluid conduit is connected in fluid communication with said third fluid conduit.

16. The system of claim 15, further comprising:

an internal combustion engine connected in fluid communication with said fuel pump.

17. The system of claim 16, further comprising:

a compressor connected in torque transmitting relation with said internal combustion engine.

* * * * *

UNITED STATES PATENT AND TRADEMARK OFFICE

CERTIFICATE OF CORRECTION

PATENT NO. : 5,020,566

DATED : June 4, 1991

INVENTOR(S) : JOHN C. SHOOP

It is certified that error appears in the above—identified patent and that said Letters Patent is hereby corrected as shown below:

In column 8, line 35, cancel "second" and insert in its place -- third --.

In column 9, line 15, cancel "second" and insert in its place -- first --.

Signed and Sealed this

Twenty-fourth Day of August, 1993

Bruce Lehman

*Attest:*

BRUCE LEHMAN

*Attesting Officer*

*Commissioner of Patents and Trademarks*